US007121862B2

(12) United States Patent
Tang et al.

(10) Patent No.: US 7,121,862 B2
(45) Date of Patent: Oct. 17, 2006

(54) ELECTRICAL CONNECTOR WITH AN IMPROVED RETAINER

(75) Inventors: WenJun Tang, Kunsan (CN); XueWu Bu, Kunsan (CN)

(73) Assignee: Hon Hai Precision Ind. Co., LTD, Taipei Hsien (TW)

( * ) Notice: Subject to any disclaimer, the term of this patent is extended or adjusted under 35 U.S.C. 154(b) by 10 days.

(21) Appl. No.: 11/000,754

(22) Filed: Nov. 30, 2004

(65) Prior Publication Data

US 2005/0124192 A1 Jun. 9, 2005

(30) Foreign Application Priority Data

Dec. 9, 2003 (CN) ..... 2003 2 0120630

(51) Int. Cl.
*H01R 13/62* (2006.01)

(52) U.S. Cl. ..... 439/327

(58) Field of Classification Search ..... 439/327, 439/328, 325, 326, 153
See application file for complete search history.

(56) References Cited

U.S. PATENT DOCUMENTS 3,829,741 A * 8/1974 Athey ..... 361/756
4,192,478 A * 3/1980 Coules ..... 248/220.31
4,195,478 A * 4/1980 Rao et al. ..... 60/282
4,712,939 A * 12/1987 Fujimoto ..... 403/24
4,927,111 A * 5/1990 Takahashi ..... 248/500
4,966,482 A * 10/1990 Fujimoto ..... 403/24
5,594,627 A * 1/1997 Le ..... 361/801
5,727,970 A 3/1998 Koguchi et al.
6,361,343 B1 * 3/2002 Daskalakis et al. ..... 439/327
6,361,344 B1 3/2002 Yu
6,368,124 B1 4/2002 Wang
6,551,120 B1 * 4/2003 Daskalakis et al. ..... 439/328
6,672,888 B1 * 1/2004 Ku ..... 439/153
6,824,413 B1 * 11/2004 Shipe et al. ..... 439/326
2005/0009396 A1 * 1/2005 Wu ..... 439/327

* cited by examiner

*Primary Examiner*—Ross Gushi
(74) *Attorney, Agent, or Firm*—Wei Te Chung

(57) ABSTRACT

A card edge connector assembly is adapted for mounting on a printed circuit board to electrically connect with a daughter card. The connector assembly includes a dielectric housing defining a longitude direction, a transverse direction perpendicular to the longitude direction and a slot extending from a mating face thereof along the longitudinal direction, a number of terminals respectively disposed at opposite sides of the slot and a retainer aligned with and spaced from the dielectric housing along the longitudinal direction. The retainer includes a flexible arm extending away from the dielectric housing. The flexible arm is formed with a projection for locking the daughter card in position.

13 Claims, 4 Drawing Sheets

ELECTRICAL CONNECTOR WITH AN IMPROVED RETAINER

BACKGROUND OF THE INVENTION

1. Field of the Invention

The present invention relates to an electrical connector, and more particularly to a card edge connector having an improved retainer.

2. Description of Related Art

A card edge connector is widely used to connect a daughter Printed Circuit Board (PCB) to a mother PCB. A typical type of the card edge connector is used for connecting an Accelerated Graphics Port (AGP) card to a computer mother board. A conventional card edge connector comprises an insulative housing defining an elongate central slot for receiving a mating edge of a daughter board. Two rows of passageways are defined on opposite sides of the central slot for receiving and retaining conductive contacts which are allowed to engage conductive pads on the mating edge of the daughter board obvious. Such a connector cannot securely retain the daughter board in the card edge connector when the card edge connector or the daughter board is subject to vibration. Thus, an AGP connector equipped with a retainer is desired to secure the daughter board.

U.S. Pat. No. 6,368,124 discloses a conventional AGP connector with a separate retainer. The separate retainer has an elongated frame tightly enclosing a dielectric housing of the AGP connector and a resilient arm integrally extending from one end of the frame along a longitudinal direction of the dielectric housing and having a projection formed thereon. The resilient arm allows a user to selectively engage/disengage the projection with/from a notch of the daughter board. However, it is clear that the retainer with a complicated structure is difficult and costly to manufacture. Furthermore, during the course of releasing the daughter board, the deflection of the resilient arm would cause the dielectric housing slightly shaking along a transverse direction of the housing. Repeated shaking would adversely affect the signal transmission between the mother PCB and the daughter PCB.

Hence, a card edge connector with improved retainer is desired to overcome the disadvantage of the prior art.

SUMMARY OF THE INVENTION

An object of the present invention is to provide a card edge connector having a separated retainer reliably mounted on a printed circuit board.

To achieve the above object, a card edge connector is adapted for mounting on a printed circuit board to electrically connect with a daughter card. The connector assembly includes a dielectric housing defining a longitude direction, a transverse direction perpendicular to the longitude direction and a slot extending in a mating face thereof along the longitudinal direction, a number of terminals respectively disposed at opposite sides of the slot and a retainer aligned with and spaced from the dielectric housing along the longitudinal direction. The retainer includes a flexible arm extending away from the dielectric housing. The flexible arm is formed with a projection for locking the daughter card in position.

Other objects, advantages and novel features of the invention will become more apparent from the following detailed description when taken in conjunction with the accompanying drawings.

DETAILED DESCRIPTION OF THE PREFERRED EMBODIMENT

Figure 3:
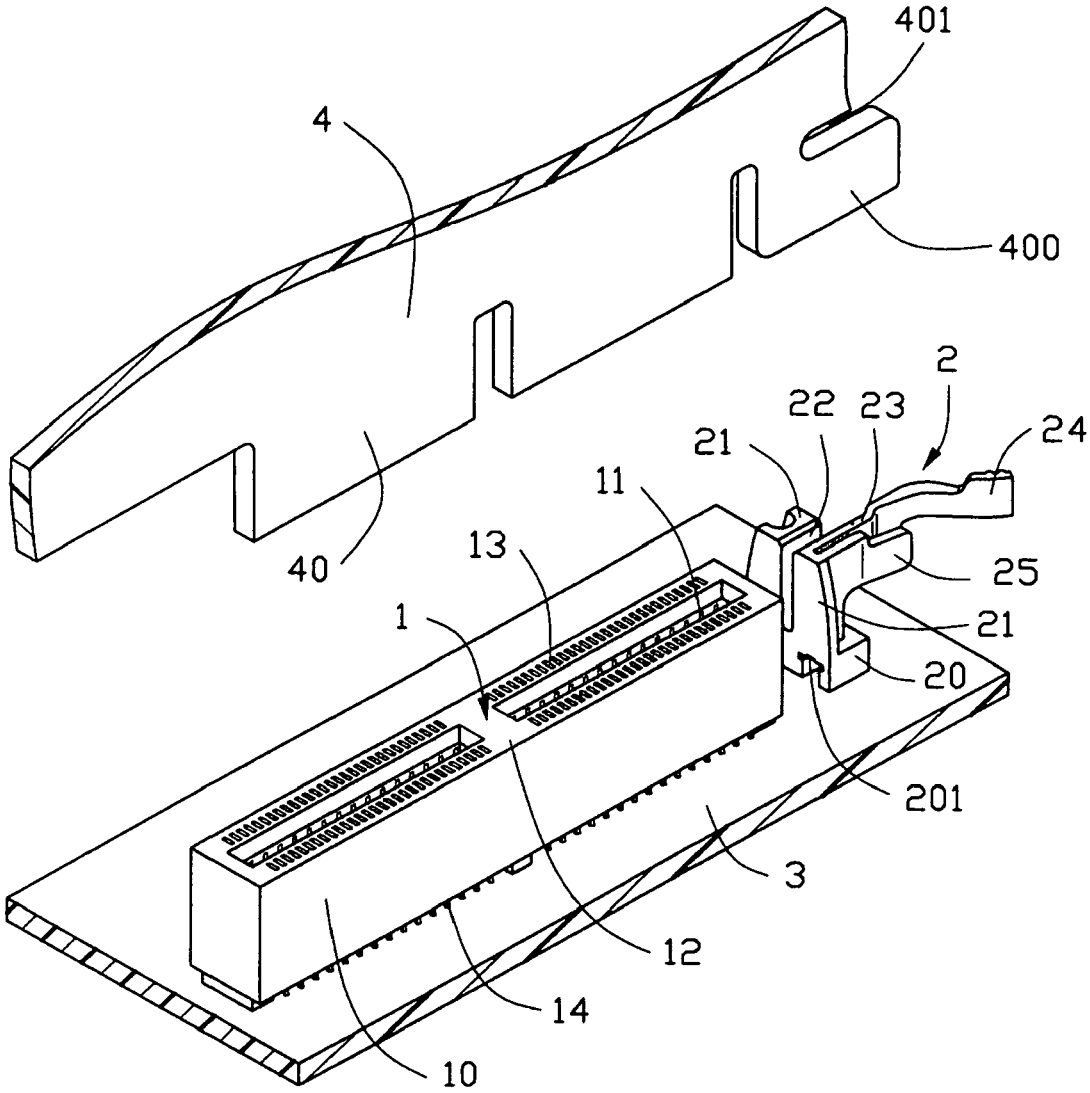
FIG. 3 is a exploded perspective view of a card edge connector assembly mounted on a printed circuit board and a daughter card.
Figure 4:
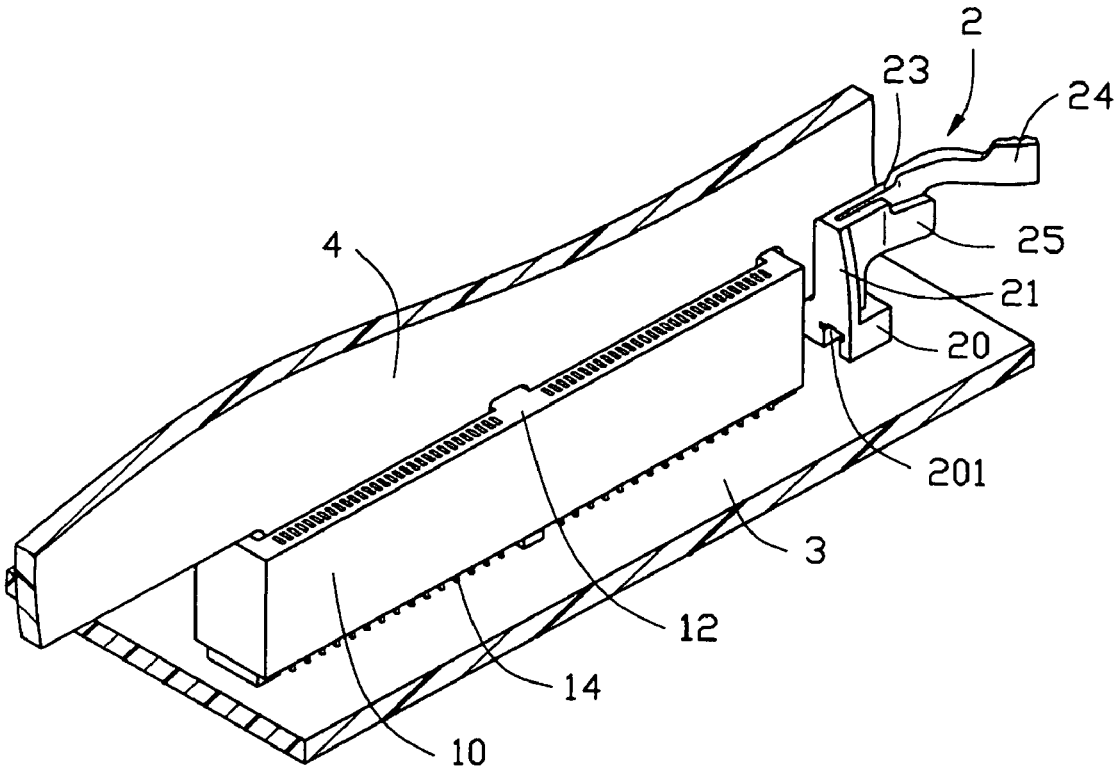
FIG. 4 is an assembled perspective view of the card edge connector assembly and the daughter card shown in FIG. 3.

Referring to FIGS. 3 and 4, a card edge connector assembly comprises an elongated card edge connector 1 and a retainer 2 in accordance with the present invention both mounted on a printed circuit board (PCB) 3. The retainer 2 is aligned with and spaced from the elongated card edge connector 1 along a longitudinal direction of the card edge connector 1. The card edge connector 1 is adapted for receiving a mating edge 40 of a daughter card 4 to establish an electrical connection between the PCB 3 and the daughter card 4. The retainer 2 is adapted for retaining one end 400 of the mating edge 40 of the daughter card 4 and cooperates with the card edge connector 1 to ensure the reliable connection between the PCB 3 and the daughter card 4, thereby securing the signal transmission between the PCB 3 and the daughter card 4. There is a distance between the card edge connector 1 and the card retainer 2. The size of the distance depends on an outline of the daughter board 4.

Referring to FIG. 3 again, the card edge connector 1 comprises an elongated dielectric housing 10 defining an elongated slot 11 extending from a mating face 12 thereof along the longitudinal direction thereof and a plurality of passageways 13 respectively defined on opposite longitudinal sides of the slot 11. A plurality of terminals 14 are respectively received in corresponding passageways 13 with solder tails thereof extending beyond a mounting face (not labeled) of the dielectric housing 10 for electrically connecting with circuit traces on the PCB 3 and with contact portions thereof extending into the slot 11 for electrically connecting with circuit traces on the daughter card 4.

Figure 1:
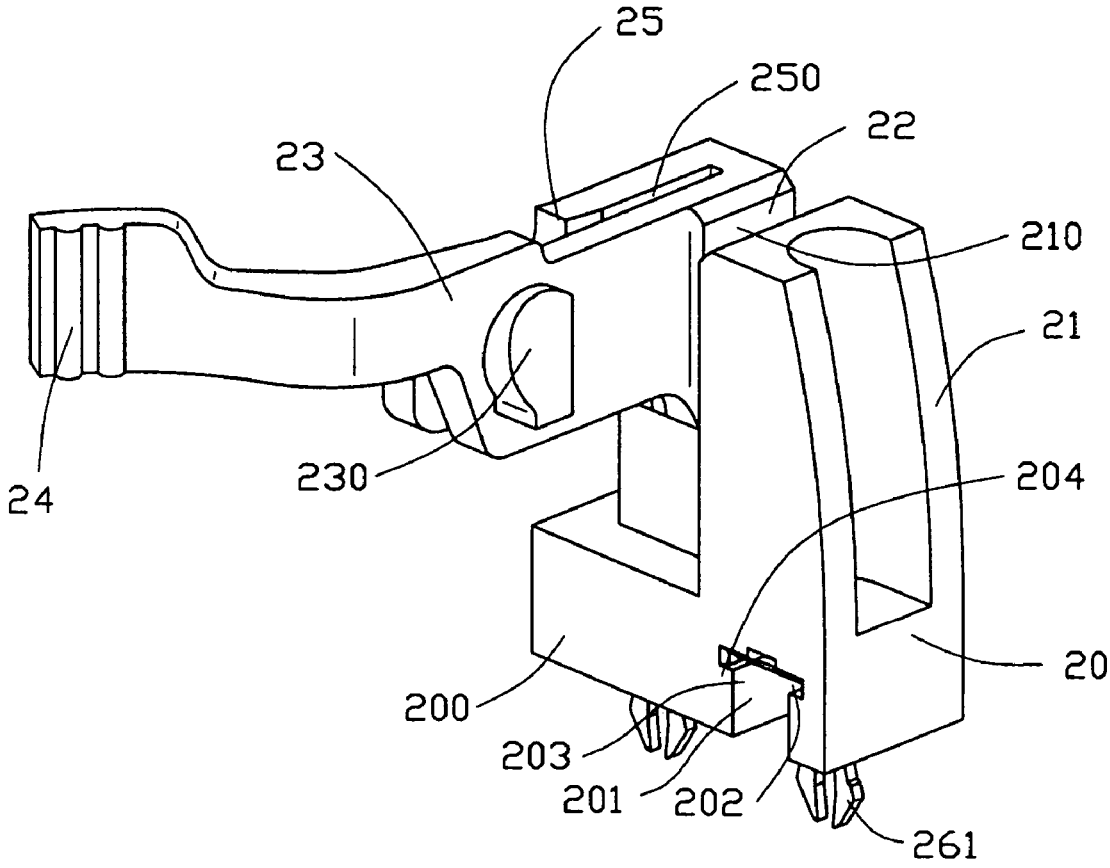
FIG. 1 is an enlarged perspective view of a retainer in accordance with the present invention.
Figure 2:
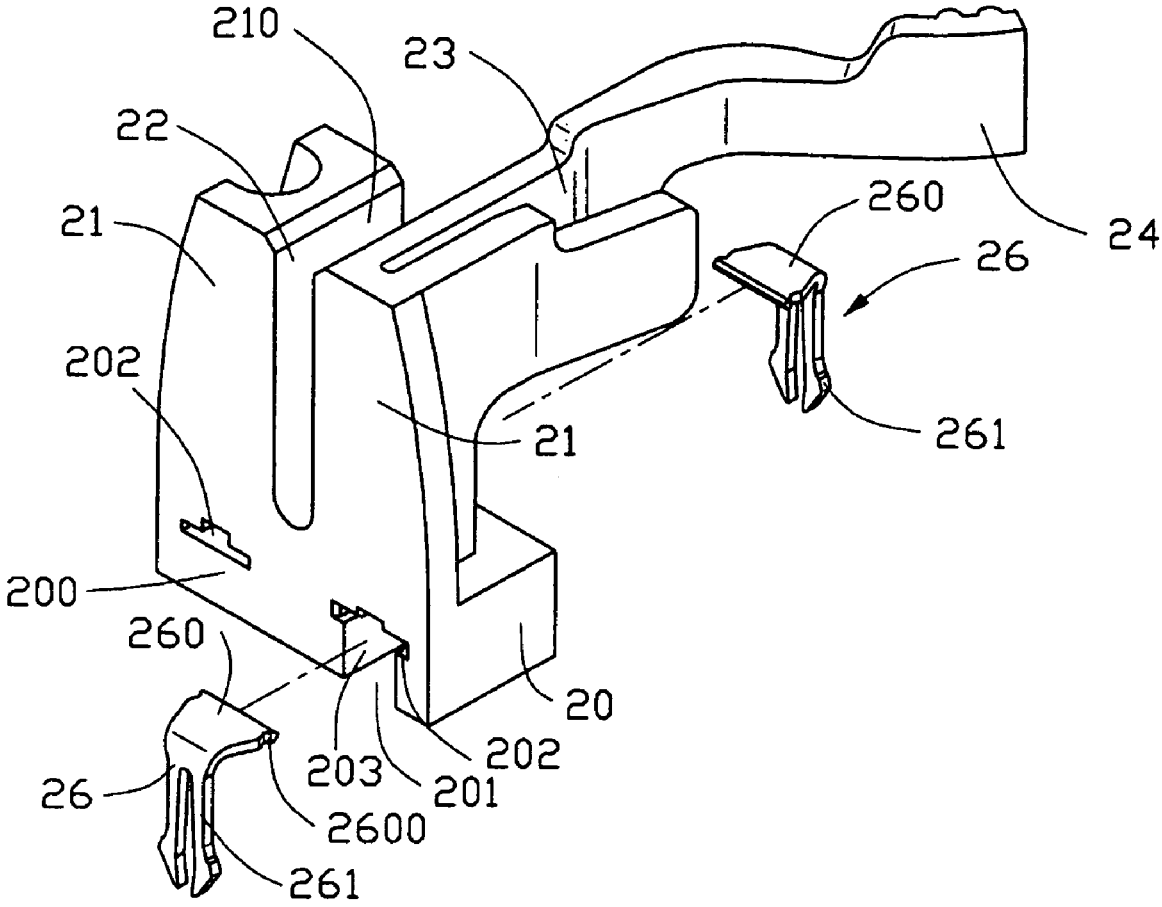
FIG. 2 is an exploded perspective of the retainer shown in FIG. 1.

Referring to FIGS. 1 and 2 in conjunction with FIG. 3, the retainer 2 comprises a base 20 and a pair of upwardly extending beams 21 which are integrally formed with the base 20 and preferably are spaced from each other along a transverse direction of the card edge connector 1 to define a space 22 therebetween. A flexible arm 23 extends from one beam 21 in a direction away from the card edge connector 1 and offsets from a longitudinal axis of the slot 11 of the dielectric housing 10. The flexible arm 23 is formed with a projection 230 extending toward the other beam 21 and beyond an inner face 210 of the one beam 21. Referring to FIGS. 3 and 4, when the daughter card 4 is inserted into the card edge connector 1, the end 400 of the mating edge 40 of the daughter card 4 is received in the space 22 and sandwiched between the beams 21. The flexible arm 23 first deflects outwardly due to push of the daughter card 4 and then snaps back by its resiliency to cause the projection 230 snapping into a recess 401 defined in the daughter card 4 to lock the daughter card 4 in position.

The retainer 2 comprises a release button 24 laterally extending from and located at a free end of the flexible arm 23. The release button 24 allows an operator to conveniently press on the release button to release the daughter card 4 from the locking portion 230. A stopper 25 extends from the beam 21 in a direction away from the card edge connector 1 and outwardly offsets from the flexible arm 23 to define a slit 250 therebetween. The stopper 25 is adapted for protecting the flexible arm 23 from over-deflecting outwardly during the course of releasing the daughter card 4.

Referring to FIG. 2 in conjunction with FIG. 3, the base 20 defines a pair of cutouts 201 respectively extending from opposite side faces 200 thereof. Each cutout 201 comprises a recess 202 substantially parallel to the mounting face of the base 20 and a groove 203 extending through the mounting face of the base 20 and in communication with the recess 202, wherein the recess 202 of one cutout 201 passes through both the side faces 200 of the base 20 for molding simplicity. The retainer 2 further comprises a pair of board locks 26 retained in the cutouts 201, respectively. Each board lock 26 has a mounting plate 260 received in the recess 202 and a pair of legs 261 substantially extends perpendicularly from the mounting plate 260 into the groove 203. The mounting plate 260 has a plurality of barbs 2600 inferentially engaging with the retaining recess 202. The width of the recess 202 is longitude than the width of the groove 203, thereby defining a shoulder 204 to support the mounting plate 260 in position. The legs 261 of each board lock 26 extend beyond the mounting face of the base 20 and fit in a hole defined in the PCB 3. It should be noted that the board locks are spaced from each other along both the transverse direction and the longitudinal direction of the electrical card edge connector 1, thereby reliably securing the retainer 2 in position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector assembly adapted for mounting on a printed circuit board (PCB) to electrically connect with a daughter card, comprising:

a dielectric housing defining a longitudinal direction, a transverse direction perpendicular to the longitudinal direction, and a slot extending in a mating face thereof along the longitudinal direction;

a plurality of terminals respectively disposed at opposite sides of the slot; and a retainer aligned with and spaced from the dielectric housing along the longitudinal direction, the retainer comprising a flexible arm that extends away from the dielectric housing, the flexible arm formed with a projection for locking the daughter card in position, and a pair of board locks which are spaced from each other along the transverse direction and the longitudinal direction of the longitudinal direction of the dielectric housing.

2. The card edge connector assembly according to claim 1, wherein the retainer comprises a base for receiving the board locks.

3. The card edge connector assembly according to claim 2, wherein each board lock comprises a mounting plate retained in the base and a pair of retaining legs perpendicularly extending from the mounting plate.

4. The card edge connector assembly according to claim 3, wherein the base defines a pair of recesses parallel to the PCB respectively on opposite side faces thereof for retaining the mounting plates of the board locks, and wherein one recess passes through both side faces of the base.

5. The card edge connector assembly according to claim 1, wherein the retainer further comprises a release button laterally extending from the flexible arm.

6. The card edge connector assembly according to claim 1, wherein the retainer further comprises a stopper offsetting from the flexible arm to protect the flexible arm from over-deflecting.

7. The card edge connector assembly according to claim 1, wherein the retainer further comprises a base and a pair of beams upwardly extending from the base and spaced from each other along the transverse direction of the dielectric housing to define a space therebetween.

8. The card edge connector assembly according to claim 7, wherein the flexible arm extends from one of the beams.

9. An electrical assembly comprising:

a printed circuit board (PCB);

a card edge connector mounted on the PCB, comprising:

a dielectric housing defining a longitudinal direction, a transverse direction perpendicular to the longitudinal direction, a slot extending from a mating face thereof along the longitudinal direction;

a plurality of terminals respectively disposed at opposite sides of the slot; and a separate retainer mounted on the PCB and aligned with the dielectric housing along the longitudinal direction, the retainer comprising a base, a flexible arm offsetting from a longitudinal axis of the slot and extending from the base in a direction away from the dielectric housing and a pair of board locks retained in the base, the flexible arm being formed with a projection for locking a daughter card in position and the board locks being spaced from each other along the transverse direction and the longitudinal direction of the dielectric housing.

10. An electrical connector assembly comprising:

a print circuit board;

an electrical connector mounted on the printed circuit board, said connector including:

an elongated insulative housing defining a central slot extending in a lengthwise direction;

a plurality of terminals disposed in the housing and mechanically and electrically connected to the printed circuit board; and a daughter card defining a first portion inserted into the central slot, and a second portion exposed outside of one end of the housing and defining a locking edge thereof; and a discrete retainer mounted to the printed circuit board and located by said end of the housing; wherein said retainer includes a removable latching head latchably engaged with the locking edge so as to pervert upward movement of the daughter card; wherein said housing defines a least one end wall in confrontation with a corresponding side edge of the daughter card so as to confine the daughter card in said lengthwise direction;

wherein said retainer is spaced from said end of the housing in said lengthwise direction.

11. The assembly as claimed in claim 10, wherein said retainer defines a slot in alignment with said central slot in said lengthwise direction.

12. The assembly as claimed in claim 10, wherein said latching head is essentially at a same level with the housing.

13. The assembly as claimed in claim 10, wherein said latching head is movable along a plane parallel to the print circuit board.

* * * * *